US005083791A

United States Patent [19]

Coombes, Jr.

[11] Patent Number: 5,083,791

[45] Date of Patent: Jan. 28, 1992

[54] GAME SUPPORT APPARATUS

[76] Inventor: Thomas W. Coombes, Jr., P.O. Box 115, Archibald, Pa. 18403

[21] Appl. No.: 680,128

[22] Filed: Apr. 3, 1991

[51] Int. Cl.[5] ..... A63F 3/02

[52] U.S. Cl. ..... 273/237; 273/241; 273/DIG. 14; 273/DIG. 24

[58] Field of Search ..... 273/237, 241, DIG. 14, 273/DIG. 24

[56] References Cited

U.S. PATENT DOCUMENTS 2,670,208 2/1954 Wales ..... 273/237

3,802,708 4/1974 Libert ..... 273/237

FOREIGN PATENT DOCUMENTS 667737 5/1952 United Kingdom ..... 273/241

OTHER PUBLICATIONS

Popular Mechanics "Spherical Chess", Aug. 1972, p. 110.

*Primary Examiner*—Benjamin Layno

*Attorney, Agent, or Firm*—Leon Gilden

[57] ABSTRACT

A tri-level apparatus is provided formed with an opaque base mounting a transparent central and transparent top plate, each of the levels arranged parallel relative to one another. The levels are arranged to accommodate various role playing games permitting positioning of figures on each of the levels, with the levels corresponding to subterranean, ground support, and inflight or heavily positioning of various figures in a role playing game situation. The organization to enhance enjoyment and utilization in limited light situations includes illuminated transparent columns supporting the levels, as well as a timer mechanism to preset a time sequence for a plurality of players utilizing the organization in a role playing game situation.

4 Claims, 4 Drawing Sheets

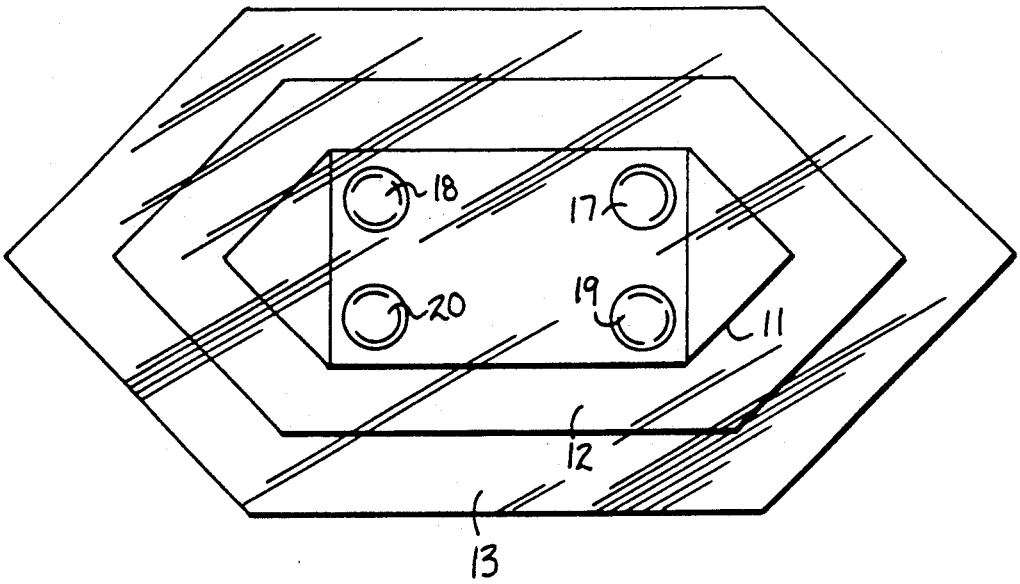
FIG 2
FIG 3
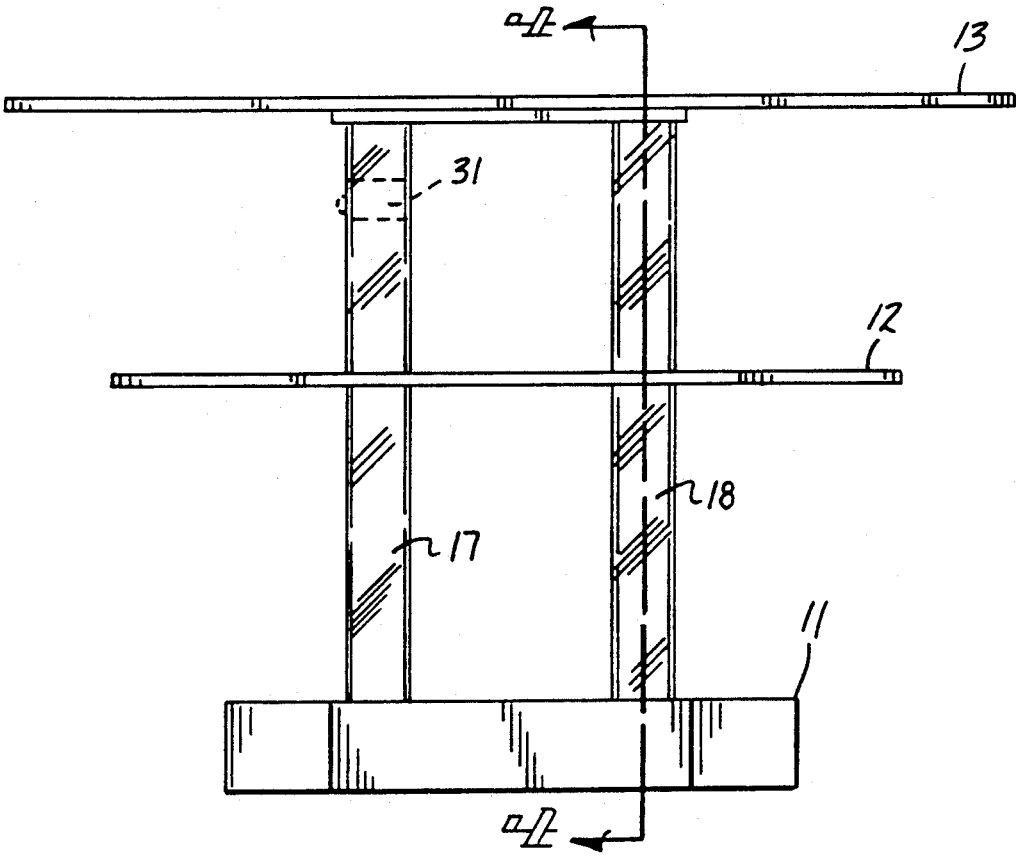

GAME SUPPORT APPARATUS

BACKGROUND OF THE INVENTION

1. Field of the Invention

The field of invention relates to game apparatus, and more particularly pertains to a new and improved game support apparatus wherein the same is utilized for role playing games.

2. Description of the Prior Art

Role playing games, contemporarily known as DUNGEONS AND DRAGONS (®) are of increasing popularity. Aspects of the role playing game includes the various positioning of various figures in various physical orientations relative to one another. The instant invention sets forth a support apparatus to provide a convenient and readily utilized support apparatus for use in such game situations. Prior art multi-level game support apparatus may be found for example in U.S. Pat. No. 4,648,601 to Carmichael utilizing a multi-level board game wherein the board game includes a path of various flights.

U.S. Pat. No. 4,348,027 to Kelly sets forth a multi-level board game utilizing a planar support with a plurality of various squares of various colorations positioned at various heights relative to a support.

U.S. Pat. No. 4,883,278 to Scott sets forth a multi-level game apparatus utilizing spaced planar support surfaces.

U.S. Pat. No. 4,534,565 to Hube sets forth a multi-level board game in a container structure that is open to present various levels at various sides of the game apparatus.

As such, it may be appreciated that there continues to be a need for a new and improved game support apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of game apparatus now present in the prior art, the present invention provides a game support apparatus wherein the same is arranged for supporting and positioning players in role playing games at various support levels. As such, the general purpose of the present invention, which will be described subsequently in greater detail, is to provide a new and improved game support apparatus which has all the advantages of the prior art game apparatus and none of the disadvantages.

To attain this, the present invention provides a tri-level apparatus formed with an opaque base mounting a transparent central and transparent top plate, each of the levels arranged parallel relative to one another. The levels are arranged to accommodate various role playing games permitting positioning of figures on each of the levels, with the levels corresponding to subterranean, ground support, and in-flight or heavily positioning of various figures in a role playing game situation. The organization, to enhance enjoyment and utilization in limited light situations, includes illuminated transparent columns supporting the levels, as well as a timer mechanism to preset a time sequence for a plurality of players utilizing the organization in a role playing game situation.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved game support apparatus which has all the advantages of the prior art game apparatus and none of the disadvantages.

It is another object of the present invention to provide a new and improved game support apparatus which may be easily and efficiently manufactured and marketed.

It is a further object of the present invention to provide a new and improved game support apparatus which is of a durable and reliable construction.

An even further object of the present invention is to provide a new and improved game support apparatus which is susceptible of a low cost of manufacture with regard to both materials and labor, and which accordingly is then susceptible of low prices of sale to the consuming public, thereby making such game support apparatus economically available to the buying public.

Still yet another object of the present invention is to provide a new and improved game support apparatus which provides in the apparatuses and methods of the prior art some of the advantages thereof, while simultaneously overcoming some of the disadvantages normally associated therewith.

Still another object of the present invention is to provide a new and improved game support apparatus wherein the same is arranged for various positioning and association of figures utilized in role playing games.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an orthographic top view of the instant invention.

FIG. 3 is an orthographic side view of the instant invention.

DESCRIPTION OF THE PREFERRED EMBODIMENT

Figure 1:
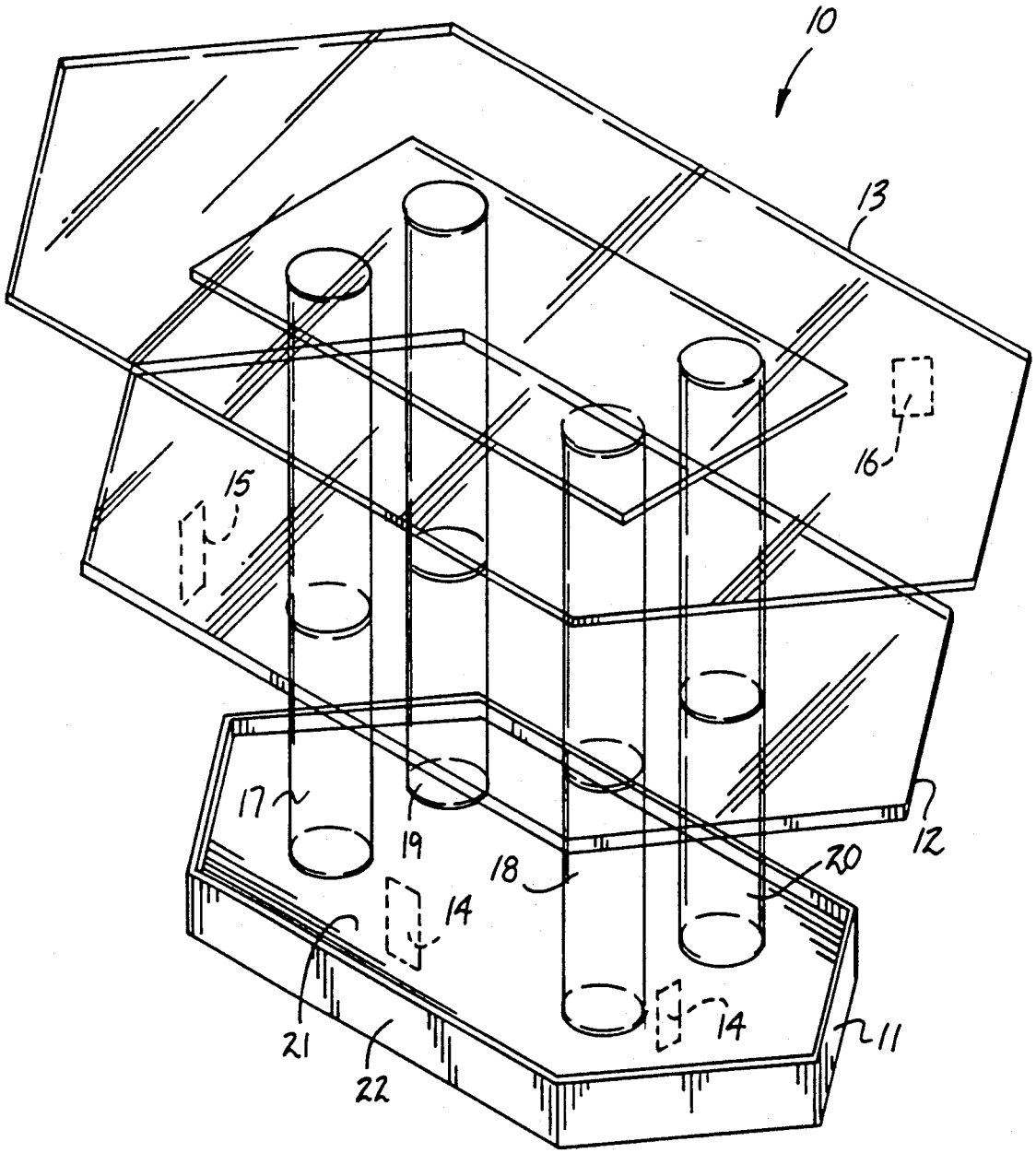
FIG. 1 is an isometric illustration of the instant invention.
Figure 4:
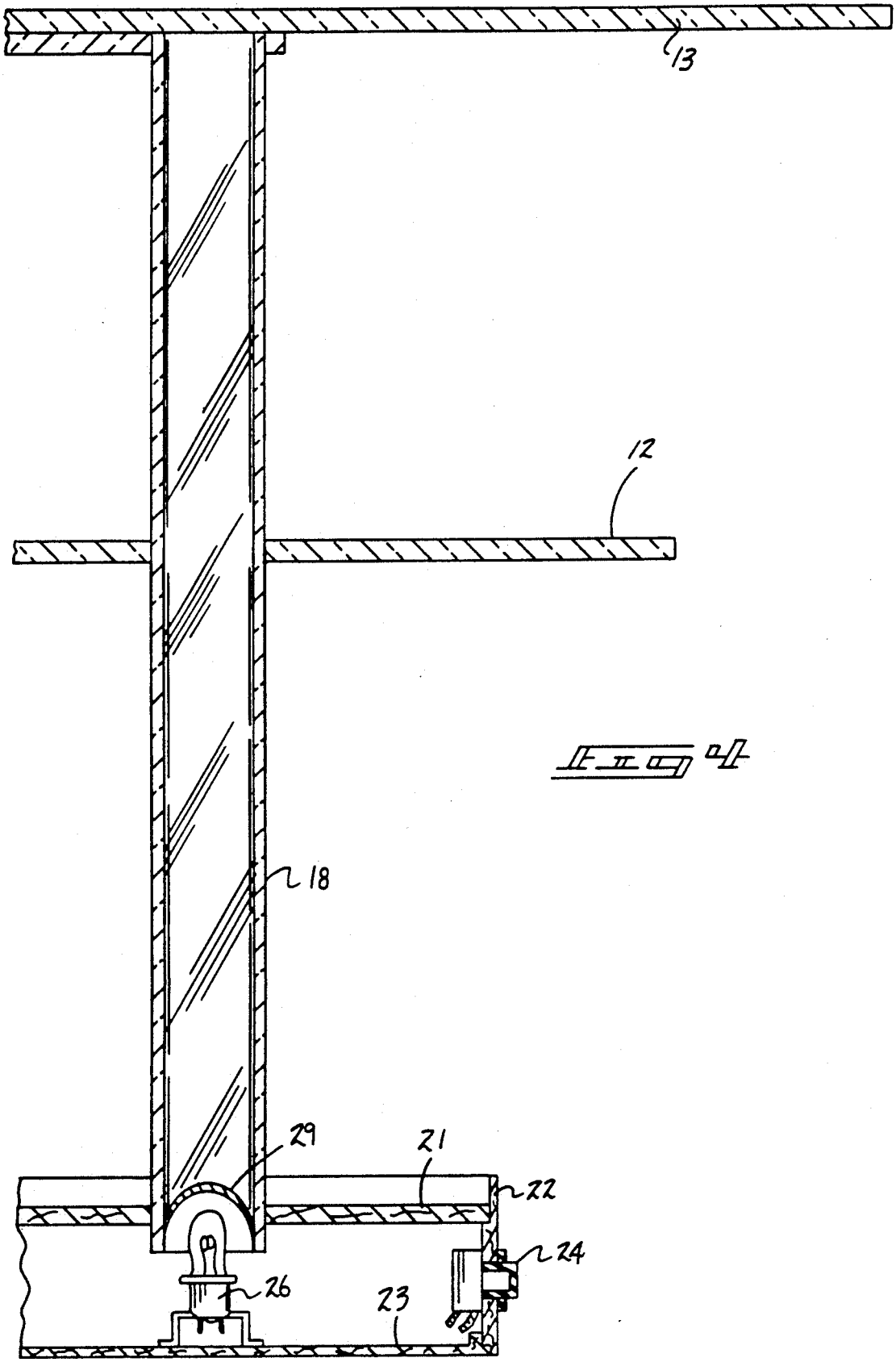
FIG. 4 is an orthographic view, taken along the lines 4—4 of FIG. 3 in the direction indicated by the arrows.

With reference now to the drawings, and in particular to FIGS. 1 to 6 thereof, a new and improved game support apparatus embodying the principles and concepts of the present invention and generally designated by the reference numeral 10 will be described.

More specifically, the game support apparatus 10 of the instant invention essentially comprises a base member 11 formed with a base member planar top upper floor 21 to receive various inserts therein, such as an opaque surface as illustrated, or selectively a mirrored surface and the like. A central transparent planar support 12 is spaced parallel to and above the base member 11, with a top transparent planar support 13 spaced above and parallel the base member 11 and central transparent planar support 12. The respective supports are arranged to position various figures, such as illustrated in phantom and depicted as respective first, second, and third FIGS. 14, 15, and 16 utilized in play of various role playing games, such as DUNGEONS AND DRAGONS (®).

Figure 5:
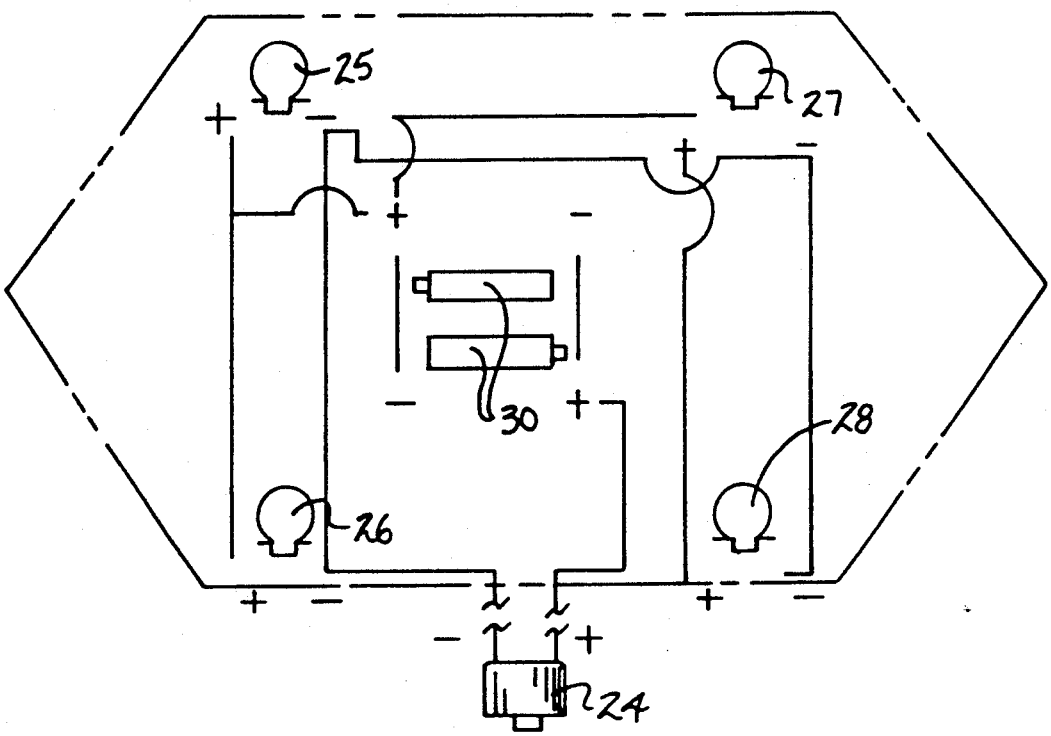
FIG. 5 is an orthographic top diagrammatic illustration of the electric circuitry utilized by the instant invention.

The base member planar upper floor 21 is spaced above and parallel a base member planar lower floor 23 to define a cavity therewithin. A perimeter wall 22 extends above the upper floor 21 in surrounding relationship to enclose the cavity. A switch 24 (see FIG. 4 for example) is arranged to project through the perimeter wall 22 and is operative to illuminate a plurality of illumination bulbs. As illustrated, the base member 11 mounts a matrix of coaxially aligned transparent support columns defined by a first coaxially aligned transparent column 17, a second column 18, a third column 19, and a fourth column 20, each of identical construction arranged parallel and coextensively relative to one another. If desired, the columns may be removably mounted relative to the base member 11 by various mechanical connections (not shown). Each transparent column 11 projects through the upper floor 21, wherein the cavity defined between the upper and lower floors includes a respective illumination bulb defined by a first illumination bulb 25, a second illumination bulb 26, a third illumination bulb 27, and a fourth illumination bulb 28, each respectively coaxially aligned with each respective first through fourth transparent column 17–20. Each illumination bulb (see FIG. 4) is positioned within a concave defuser panel 29 that is mounted within a lower terminal end of each respective transparent column to effect illumination of the transparent columns and illumination of the playing area to utilize the organization in dimly lit surroundings. The illumination bulbs are operative through a battery or plurality of batteries 30, as illustrated in FIG. 5, that is mounted within the cavity defined between the floors.

Figure 6:
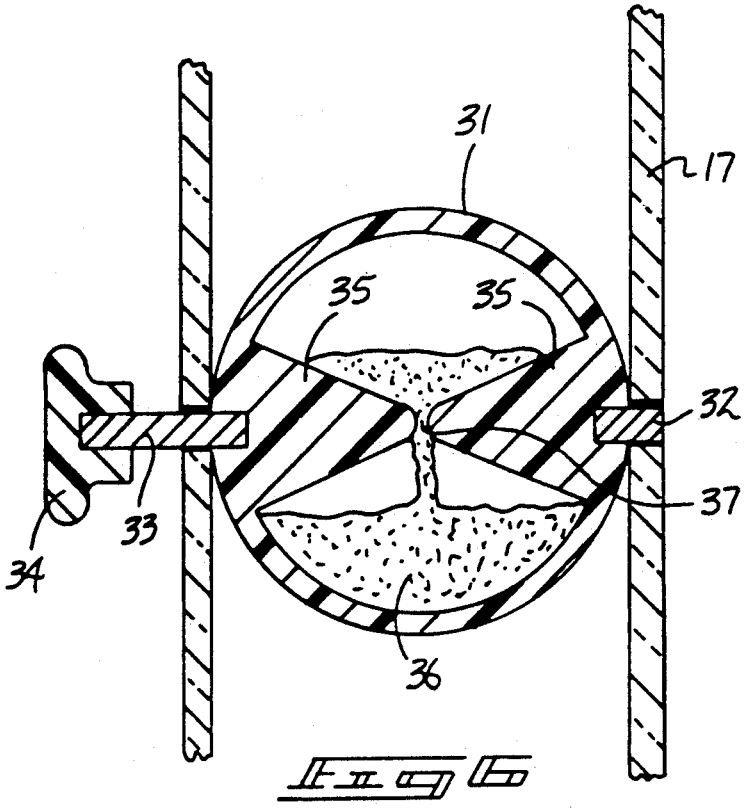
FIG. 6 is an orthographic cross-sectional illustration of a tyro mechanism utilized by the instant invention.

A timer mechanism 31 is provided to provide sequential time delays between playing by individual players, wherein the timer mechanism includes a spherical timer mechanism 31 (see FIG. 6) mounted within one of the columns adjacent the top transparent support for ease of access thereto, wherein the timer mechanism 31 is mounted by a first and second pivot axle 32 and 33 respectively that are diametrically aligned relative to one another, wherein the second pivot axle 33 includes a handle 34 that extends exteriorly of an associated transparent column. Diametrically opposed projecting wedge shaped plates 35 project to define an axially positioned plate gap 37 to permit timed release of granular material 36 from an upper position to a lower position within the timer mechanism, as illustrated in FIG. 6, to effect a timing event of a predetermined time span.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A game support apparatus, comprising in combination, a base member, the base member including an opaque upper floor, and the opaque upper floor including a plurality of spaced transparent columns, each column defined of a cylindrical configuration and the columns arranged parallel and coextensive relative to one another and mounted to the base member, and a central transparent planar support spaced above and parallel the base member directed medially and orthogonally through the transparent columns, and a top transparent planar support mounted to upper terminal ends of the transparent columns and arranged parallel to the central transparent planar support and the base member, wherein the base member, the central transparent planar support, and the top transparent planar support are arranged to receive various simulation figures thereon in playing of a role playing game, and wherein the base member includes a planar upper floor spaced from and parallel a planar lower floor, and a perimeter wall directed about the upper floor and lower floor defining a cavity therebetween, wherein the perimeter wall extends above the upper floor, and the cavity includes a plurality of illumination bulbs, and at least one illumination bulb of a plurality of illumination bulbs arranged coaxially aligned with each of the transparent columns, wherein each illumination bulb is positioned below each respective transparent column and positioned within the cavity, and a concave defuser panel mounted within the lower terminal end of each of the transparent columns oriented over each respective illumination bulb.

2. An apparatus as set forth in claim 1 including a switch member directed through the perimeter wall in electrical communication with a plurality of batteries positioned within the cavity to effect selective illumination of the plurality of illumination bulbs.

3. An apparatus as set forth in claim 2 including a timer mechanism mounted within at least one of the transparent columns adjacent the top transparent planar support.

4. An apparatus as set forth in claim 3 wherein the timer mechanism is in a circle configuration as defined by a diameter substantially equal to or less than a predetermined diameter of the transparent columns, and the timer mechanism including a first pivot axle and a second pivot axle diametrically directed through the spherical timer mechanism permitting rotation of the timer mechanism, and a handle member mounted to the second pivot axle exteriorly of the circle timer mechanism to permit manual rotation of the spherical timer mechanism, and the spherical timer mechanism including a plurality of diametrically projecting wedge shaped plates projecting towards one another defining a plate gap therebetween, and a predetermined quantity of granular material positioned within the spherical timer mechanism, wherein the granular material is metered through the plate gap to effect a timing sequence.

* * * * *